United States Patent [19]

Gruber

[11] 4,006,906

[45] Feb. 8, 1977

[54] CARD GAME

[75] Inventor: Jeffrey S. Gruber, Ile-Ife, Nigeria

[73] Assignee: The Raymond Lee Organization, Inc., New York, N.Y. ; a part interest

[22] Filed: Feb. 27, 1976

[21] Appl. No.: 662,115

[52] U.S. Cl. ..... 273/152 R; 273/152.4

[51] Int. Cl.[2] ..... A63F 1/00

[58] Field of Search ..... 273/152 R, 152.4, 152.41, 273/152.42

[56] References Cited

UNITED STATES PATENTS

| | | | |
|---|---|---|---|
| 1,100,869 | 6/1914 | Fisher | 273/152.42 |
| 2,162,428 | 6/1939 | Goldman | 273/152 R |
| 2,562,633 | 7/1951 | Needham | 273/152.4 UX |
| 2,611,616 | 9/1952 | Kloss | 273/152.41 X |

OTHER PUBLICATIONS

"The 2nd Scientific American Book of Mathematical Puzzles and Diversions" by Martin Gardner, Simon & Schuster, New York, copyright 1961, pp. 165–173.

*Primary Examiner*—Anton O. Oechsle
*Attorney, Agent, or Firm*—Daniel Jay Tick

[57] ABSTRACT

A card game has a creator's card and 120 additional cards. The 120 cards are divided into 12 groups each having 10 cards numbered zero to 9. The cards are divided into 4 groups each having 30 cards of the same pattern of one of a bar, an arc, a point and a semicircle. The cards are divided into three groups each having 40 cards of the same color of one of three colors.

2 Claims, 9 Drawing Figures

CARD GAME

BACKGROUND OF THE INVENTION:

The present invention relates to a card game.

Objects of the invention are to provide a card game which is played with a plurality of playing cards, which is creative, interesting, amusing, mentally stimulating and recreational to participants and onlookers alike.

BRIEF DESCRIPTION OF THE DRAWINGS:

In order that the invention may be readily carried into effect, it will now be described with reference to the accompanying drawings, wherein.

Figure 1:
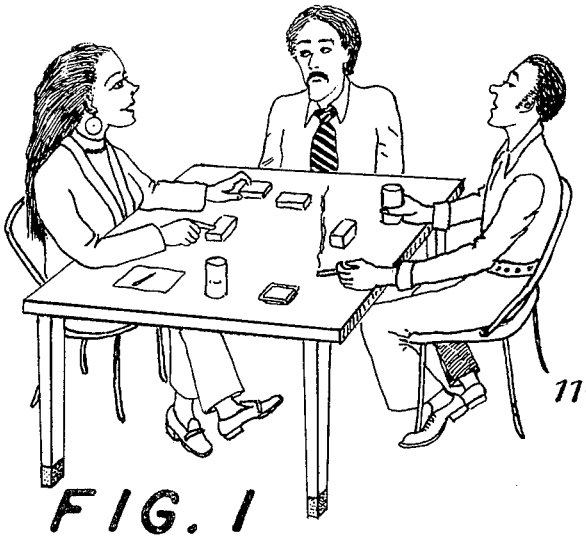
FIG. 1 is a perspective view of the card game of the invention being played.
Figure 2:
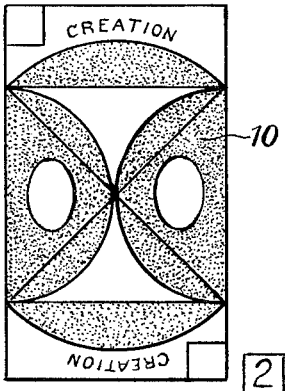
FIG. 2 is a view of the creator's card of the card game of the invention.
Figure 3:
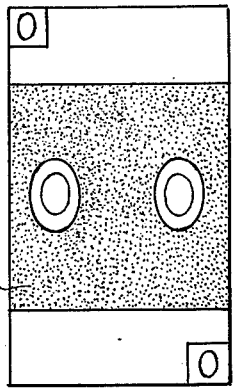
FIG. 3 is a view of a bar pattern card of the card game of the invention.
Figure 4:
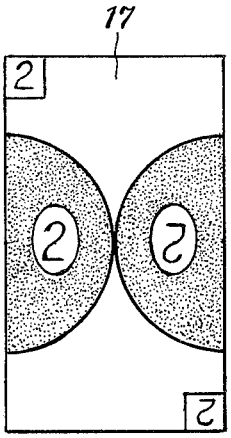
FIG. 4 is a view of a semicircle pattern card of the card game of the invention.
Figure 5:
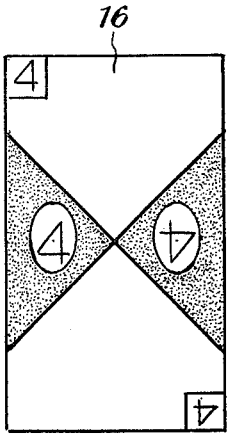
FIG. 5 is a view of a point pattern card of the card game of the invention.
Figure 6:
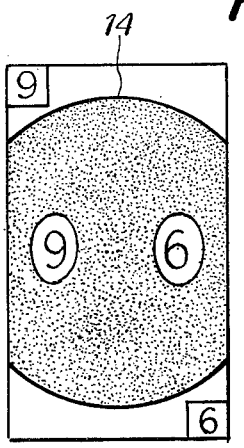
FIG. 6 is a view of an arc pattern card of the card game of the invention.
Figure 7:
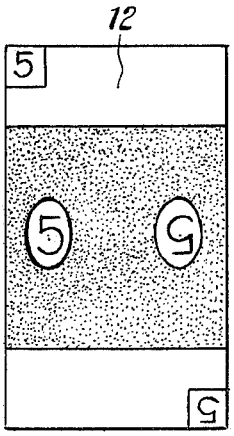
FIG. 7 is a view of another bar pattern card of the card game of the invention.
Figure 8:
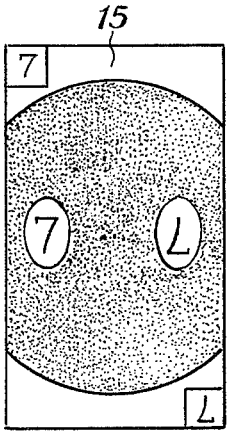
FIG. 8 is a view of another arc pattern card of the card game of the invention.
Figure 9:
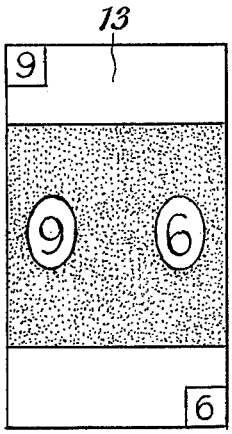
FIG. 9 is a view of another bar pattern card of the card game of the invention.

DETAILED DESCRIPTION OF THE INVENTION:

The card game of the invention comprises a creator's card 10, shown in FIG. 2. Aside from the creator's card, the card game of the invention has 120 cards, which are divided into 12 groups each having 10 cards numbered zero to 9. The 120 cards are divided into 4 groups, each having 30 cards of the same pattern. Thus, 30 cards have a bar pattern as represented by the cards 11, 12 and 13 of FIGS. 3, 7 and 9. 30 cards have an arc pattern, as represented by the cards 14 and 15 of FIGS. 6 and 8. 30 cards have a point pttern, as represented by the card 16 of FIG. 5. The remaining 30 cards have a semicircle pattern, as indicated by the card 17 of FIG. 4.

The 120 cards are divided into 3 groups, each having 40 cards of the same color of one of three different colors. Thus, 40 cards are red, 40 cards are green and the remaining 40 cards are blue.

The card game of the invention, which is known as Creation, is played with a pack of specially designed cards, or tiles denoting features such as color, number, and pattern. Three or more persons play. Each player is provided with a piece of paper and a pencil. The creator or dealer is chosen by players drawing one card each from the pack, the one drawing the highest numbered card being the creator for the first hand. The entire pack is then dealt out, evenly, among the other players, excluding the creator, who keeps only the creator's card. The creator then makes up a 'law of creation'. For example, it may be something simple like 'each card is a different color from the one before it' or 'an odd number must follow an even, and vice versa.' The law is any rule, using any of the features or a combination of the features on the cards, that defines the order of cards in a sequence. The creator secretly writes down his law on his piece of paper to be referred to at the end of the hand. The object of the other players is to build up a sequence of cards to fit this law, and at the same time try to find out what the law is.

To start the hand, the creator puts on the table his creator's card as the first card of the sequence, and tells the players what the card denotes, for example 'red-3-bar'. He also states the limit on the number of cards to be allowed after the creator's card in the sequence for that hand. Usually 20 is good. The play begins to the left of the creator and moves clockwise, each player in turn laying down a card from his hand as the next card of the sequence. If it fits the law, the creator says 'yes', if not, 'no'. 'Yes' cards stay in the center of the table in the sequence. 'No' cards are placed in front of each player, face upwards, so that players can see which cards have been rejected. For each 'yes' card a player makes, he gets a point. In addition he is allowed, before his next turn, to ask the creator a question answerable by 'yes' or 'no' about the law. The question must be asked secretly, written down and passed to the creator. For example, 'Does the law have anything to do with color, or number, or pattern?'

After a sequence of 'yes' cards has been formed on the table, it may be possible for a player to guess the law. If a player thinks he knows it, he may, if his last play was a 'yes' card, ask about it, using a question of the form 'Is the law such-and-such'. For example, 'Is the law that no two cards next to each other have the same color'. If his hunch is correct and amounts to the same thing as the law, even though not stated in the same way, the player is said to have gotten the law. He then gets a bonus of 10 points plus the number of 'yes' cards yet to go to reach the limit of the sequence stated at the beginning of the hand. For example, if the stated limit is 20, and a player gets the law when there are 8 'yes' cards in it, he gets $10 + 12 = 22$ points. The player who gets the law first continues to play and gets additional points for 'yes' cards still played. The hand ends when a second person gets the law or when the sequence limit is reached. If neither of these events occurs, the hand ends when players run out of cards in their hands, or when the creator sees that there are no more cards that can be played to fit the law. The scores of the players are then added up. The creator's score is twice the difference between the two highest scores among the players.

The deal moves clockwise, the person to the left of the last creator becoming the new creator for a new hand. At the end of each hand, accumulative scores are totaled. The game ends after one or more rounds, each person having the same number of chances to be creator.

A convenient way to keep score is with chips. The creator counts out at the start of the hand a number of chips equal to the sequence limit. Each time a person gets a 'yes' card he gives the player one of these chips. When a player gets the rule the creator gives him 10 extra chips plus a number equal to the number remaining of these, but takes them from a reserve pile. A player's score is then just the number of chips he has accumulated.

A player whose last card was 'yes' may, instead of asking a question, exchange any card in his hand with any card in any of the 'no' piles. He may then get more 'yes' cards, especially if he already knows the law and doesn't have the necessary card in his hand.

Players will try to get the law as soon as they can, as this will increase their score. A creator will try to make the law easy enough for one person to get quickly, but not so easy that two do, and not so hard that no one does, because his score depends on the difference between the two highest scores. It is better to start off playing with very simple laws and gradually increase in difficulty. The creator will also try to set the limit on the sequence so that it can get long enough for one person to get the law, but not two. The creator may give a clue to the law at any time during the hand just before the turn of the player to his left, but not if the limit will be reached in five or less more 'yes' cards. This enables him to make the law easier if he sees it proving too hard. For example, he may say, 'the law has nothing to do with the pattern on the cards'. The clue must be heard by all the players.

The game of the invention has the following advantages. The specially designed cards or tiles are attractive to play with and allow for a greater variety of possible laws, more readily available ways of being creative. It is possible to have decks or sets of special types. This has great potential as an educational game and for recreation at different age levels. For young children, sets can be made up using animals, say, or other objects, words, as well as shapes and colors. Sets with unusual features would be attractive for certain people, such as musical notes, phonetic symbols and letters. Sets could also be devised that involve 2 or 3 dimensional patterns rather than straight line sequences, for example, creating law-governed geometrical patterns on a table.

The cards can be used to create interesting 'laws of creation', such as, 'no cards next to each other have the same color', 'play a card of the same color or pattern as the previous', 'play a card of the same color, but of different pattern, from the previous', 'curved patterns alternate with straight patterns'.

When in sequence, cards can be seen to form shapes beginning and ending in a point or semicircle. A law based on this could be 'all shapes of 3 or 4 cards only', or 'all shapes the total of the numbers of the cards in them being less than 20'.

The rules of Creation are an improvement over those of similar games in that they provide a faster, more exciting game, with easier to understand scoring. The players get to do a greater number of different things in a shorter period of time, such as being creator, trying to discover the law, knowing the law while others don't, and experiencing a number of different laws. The emphasis being on building the sequence and guessing the law rather than merely getting more 'yes' cards, sustains interest, and the rules also have greater interaction between the creator and the other players.

The creator's card may be omitted from the set of cards, or made optional in play, the dealer or creator selecting any card, or selecting a card at random, to start the sequence.

It is highly advantageous to be able to play the card game of the invention with only two players. The following modified rules may be used for such a play. In a given hand the one who is creator is dealt half the deck himself and also takes his turns playing cards, playing a correct card and getting a point each time. However, the hand is valid only if the player gets the law sometime before the hand ends. If not, the same person remains the creator until he makes up a law which the other player gets. The creator's score is then just the number of points he has gotten playing correct cards, while the player's score is found in the usual way. This means that the creator will try to make up a rule which the other player will get, but not too early. General clues are not permitted for such two-person play.

While the invention has been described by means of a specific example and in a specific embodiment, I do not wish to be limited thereto, for obvious modifications will occur to those skilled in the art without departing from the spirit and scope of the invention.

I claim:

1. A card game, comprising a creator's card; and 120 cards, said cards being divided into 12 groups each having 10 cards numbered zero to 9, said cards being divided into 4 groups each having 30 cards of the same pattern of one of a bar, an arc, a point and a semicircle, and said cards being divided into 3 groups each having 40 cards of the same color of one of three colors.

2. A card game as claimed in claim 1, wherein the colors are red, green and blue.

* * * * *